United States Patent [19]

Garbacik

[11] 4,402,105

[45] Sep. 6, 1983

[54] VACUUM CLEANER ATTACHMENT

[76] Inventor: Thomas J. Garbacik, 5111 Prairie View, Brighton, Mich. 48116

[21] Appl. No.: 293,679

[22] Filed: Aug. 17, 1981

[51] Int. Cl.[3] ..... A47L 9/06

[52] U.S. Cl. ..... 15/398; 15/410; 15/415 R

[58] Field of Search ..... 15/393, 395, 396, 398, 15/400, 402, 410, 415 R

[56] References Cited

U.S. PATENT DOCUMENTS

| | | | |
|---|---|---|---|
| 1,253,939 | 1/1918 | Clarke | 15/410 X |
| 2,056,850 | 10/1936 | Goughnour | 15/410 X |
| 2,597,966 | 5/1952 | Adler | 15/415 X |
| 3,358,317 | 12/1967 | Woodruff | 15/398 |
| 4,332,051 | 6/1982 | LaMonte | 15/398 X |
| 4,374,446 | 2/1983 | Copperman | 15/415 A |

FOREIGN PATENT DOCUMENTS

| | | | |
|---|---|---|---|
| 104536 | 5/1942 | Sweden | 15/395 |

*Primary Examiner*—Chris K. Moore

*Attorney, Agent, or Firm*—Gifford, Van Ophem, Sheridan & Sprinkle

[57] ABSTRACT

A unique vacuum cleaner attachment is disclosed which is particularly suitable for cleaning steps. The vacuum cleaner attachment comprises an elongated cylindrical body having a longitudinally chamber formed in it which is open to one end of the body. The open end of the body is adapted for connection with the hose from a vacuum cleaner. An elongated handle extends laterally outwardly from the body adjacent the open end of the body while an elongated slot extends from the handle and to the other end of the body. In use, the attachment is grasped by the handle and moved across a step whereupon dirt and debris on the step is inducted through the slot and to the vacuum cleaner.

5 Claims, 4 Drawing Figures

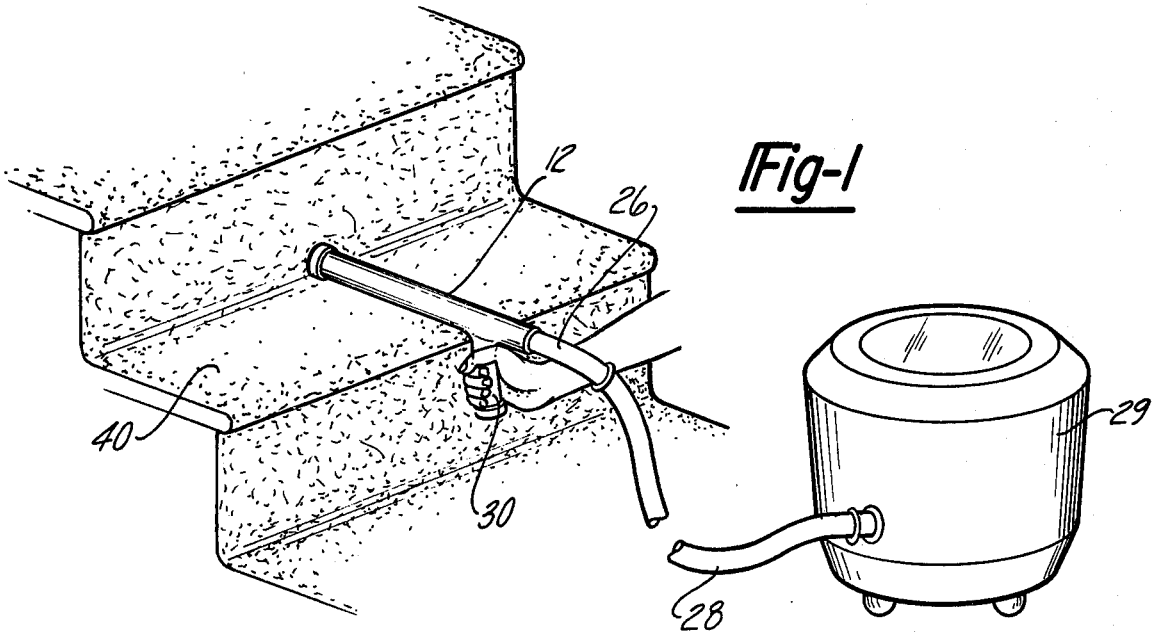
Fig-1
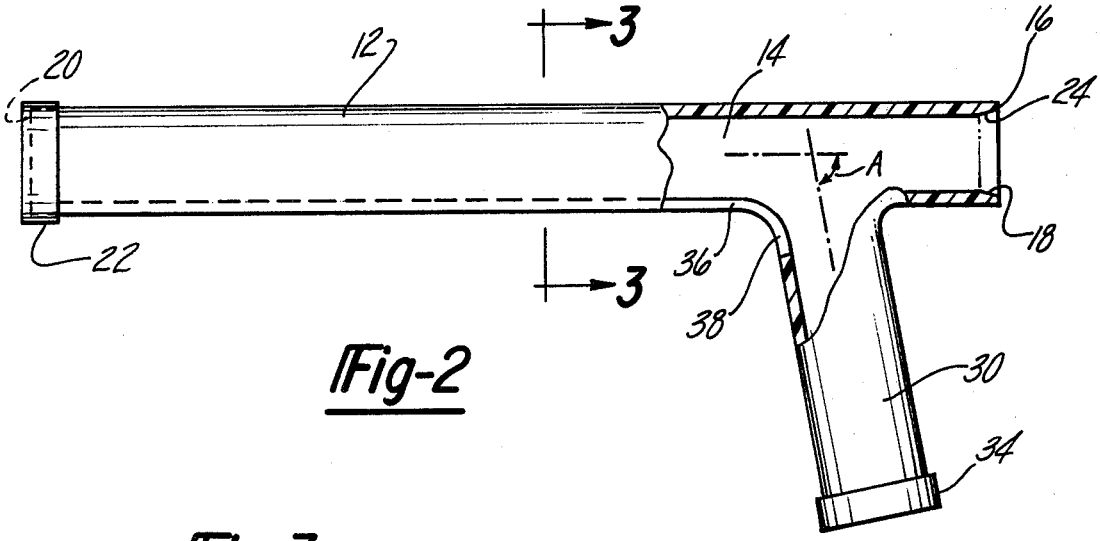
Fig-2
Fig-3
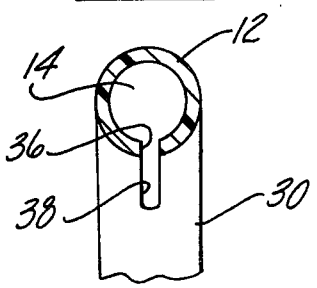
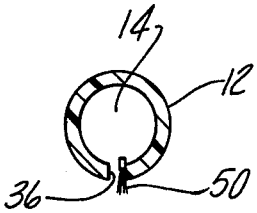
Fig-4

VACUUM CLEANER ATTACHMENT

BACKGROUND OF THE INVENTION

I. Field of the Invention

The present invention relates to an attachment for a vacuum cleaner particularly designed for cleaning steps.

II. Description of the Prior Art

Most buildings or homes either own or have access to a vacuum cleaner for cleaning the home or other building. Such vacuum cleaners usually include a main housing having a flexible hose attached at one end to it. Upon activation of the vacuum cleaner, air is inducted through the other end of the hose and to the vacuum cleaner.

There are a plurality of vacuum cleaner attachments which can be detachably connected to the free end of the hose so that air is inducted through the vacuum cleaner attachment upon activation of the vacuum cleaner. These various attachments are designed for different cleaning purposes. For example, one type of vacuum cleaner may be particularly suitable for vacuuming floor rugs while another type of attachment may be particularly suitable for upholstery cleaning.

None of the previously known vacuum cleaner attachments, however, are particularly designed for cleaning steps. Moreover, the use of other types of attachments for cleaning steps is not only awkward to accomplish but also inadequately and unsatisfactorily cleans the step. This awkwardness in using other types of attachments in the unsatisfactory cleaning obtained is due primarily to the small size and multiple corners which are found on most steps.

SUMMARY OF THE PRESENT INVENTION

The present invention overcomes the above mentioned disadvantages by providing a vacuum cleaner attachment particularly suitable for cleaning steps.

In brief, the attachment according to the present invention comprises an elongated cylindrical body. A longitudinally extending cylindrical chamber is formed in the body which is open to one end of the body. This open end of the body is dimensioned for attachment with the free end of a conventional vacuum cleaner hose.

An elongated handle is secured to and extends laterally outwardly from the body adjacent its open end. In the preferred form of the invention, the body and the handle are integrally constructed.

An elongated slot is formed along one side of the body so that the slot extends from the other end of the body and to the handle. This slot is open to the longitudinal chamber formed in the body so that, with the attachment secured to a vacuum cleaner hose, air is inducted through the slot upon activation of the vacuum cleaner. In operation, the attachment of the present invention is attached to the vacuum cleaner hose in the above described fashion and the vacuum cleaner is activated. The attachment is then held by the user grasping the handle and positioning the slot against the upper surface of the step. The entire upper surface of the step can then be cleaned by simply moving the attachment laterally across the step and then proceeding to the next step.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 1 is an elevational view illustrating the operation of the preferred embodiment of my invention;

FIG. 2 is a longitudinal partial sectional view illustrating the preferred embodiment of the present invention;

FIG. 3 is a cross sectional view taken along line 3—3 in FIG. 2; and FIG. 4 is a view similar to FIG. 3 but showing a modification thereof.

DETAILED DESCRIPTION OF A PREFERRED EMBODIMENT OF THE PRESENT INVENTION

With reference first to FIGS. 2 and 3, a preferred embodiment of the vacuum cleaner attachment 10 according to the present invention is thereshown and comprises an elongated body 12 which is preferably tubular and cylindrical in cross sectional shape. The body 12 is preferably constructed of a plastic material although other materials can alternatively be used.

A longitudinally extending interior chamber 14 is formed along the entire length of the body 12 and, in the preferred form of the invention, the chamber 14 is cylindrical in shape. The chamber 14 is open to one end 16 of the body 12 through an opening 18. Conversely, the other end 20 of the body 12 is closed by a cap 22. The cap 22 can be either integrally constructed with the body 12 or separately attached to it.

With reference now particularly to FIGS. 1 and 2, the opening 18 is defined by a surface 24 adapted to receive and frictionally engage a connector 26 of the type conventionally found on the free end of a vacuum cleaner hose 28. Other means for detachably connecting the connector 26 to the attachment opening 18 can, of course, be used.

Referring again to FIGS. 2 and 3, an elongated cylindrical handle 30 extends laterally outwardly from the body 12 adjacent its end 16. The handle 30 is preferably tubular and cylindrical in construction and integrally formed with the body 12. The free end 32 of the handle 30 is closed by a cap 34 either secured to or integrally formed with the handle 30.

As best shown in FIG. 2, in the preferred form of the invention, the axis of the handle 30 is not quite perpendicular with respect to the axis of the body 12 but, instead, is angled slightly toward the end 16 of the body 12. As shown in FIG. 2, the angle A between the intersection of the axis of the body 12 and the axis of the handle 30 is approximately 80°.

With reference again to FIGS. 2 and 3, an elongated slot 36 extends longitudinally along the body 12 from its closed end 20 and to the handle 30. This slot 36 is open to the interior chamber 14 of the body 12. One end 38 of the slot 36 is arcuately formed so that the slot end 38 extends part way down the length of the handle 30. The purpose of this arcuately formed end 38 of the slot 36 will be subsequently described.

With reference now particularly to FIG. 1, in operation, the vacuum hose connector 26 is secured to the body opening 18 so that, upon activation of the vacuum cleaner, the vacuum cleaner inducts air through the slot 36 into the body chamber 14 and out through the vacuum hose 28 to the vacuum cleaner 29. The user then grasps the handle 30 and moves the body 12 laterally across a step 40 so that the slot 36 faces downwardly towards the top of the step. Thus, as the attachment is moved across the step, dust and other debris on the step is inducted through the attachment slot 36 and to the vacuum cleaner 29 in the desired fashion. The arcuately formed end 38 of the slot 36 ensures that the front edge 42 of the step 40 is also cleaned.

With reference now to FIG. 4, a modification of the attachment 10 is thereshown in which a narrow, elongated brush 50 is attached to the housing 12 so that the brush 50 extends along one side and along the entire length of the slot 36. The brush 50 can be advantageously used with the attachment 10 when additional cleaning power is needed. If desired, the brush 50 can be detachably secured to the body 12 by any conventional means. The attachment according to the present invention is thus advantageous in several different respects. First, since the length of the slot 36 is substantially the same as the width of a conventional step 40 (FIG. 1), the entire step 40 can be easily and entirely cleaned by simply laterally moving the attachment a single time across the top of the step.

A still further advantage of the attachment according to the present invention is that the handle 30 provides a convenient means for manipulating the attachment in use.

A still further advantage of the attachment according to the present invention is that it can be inexpensively mass produced. Preferably, the attachment 10 is entirely constructed from a plastic material.

Having described my invention, however, many modifications thereto will become apparent to those skilled in the art to which it pertains without deviation from the spirit of the invention as defined by the scope of the appended claims.

I claim:

1. For use with a vacuum cleaner having a hose with a connector at one end, said vacuum cleaner, when activated, producing a vacuum at the connector, an attachment for the vacuum cleaner comprising:

an elongated body, said body having a longitudinally extending chamber formed in it, said chamber being open to one end of said body, means at said open end of the body for detachable connection with said hose connector, an elongated handle joined to and extending laterally outwardly from said body adjacent the open end of the body, said handle including an arcuate section adjacent its junction with said body, and said body and said handle including an elongated and longitudinally extending slot formed along one side of said body and said handle arcuate section, said slot being open to said chamber.

2. The invention as defined in claim 1 wherein said handle and said body are tubular and cylindrical in shape.

3. The invention as defined in claim 2 wherein said handle and said body are of a one-piece construction.

4. The invention as defined in claim 1 and including an elongated brush secured to said body and positioned adjacent said slot.

5. The invention as defined in claim 1 wherein the axes of said handle and said body intersect each other at an angle of substantially 80 degrees.

* * * * *